United States Patent [19]

Yff

[11] Patent Number: 4,979,696

[45] Date of Patent: Dec. 25, 1990

[54] SYSTEM FOR DETERMINING THE ANGULAR SPIN POSITION OF AN OBJECT SPINNING ABOUT AN AXIS

[75] Inventor: Louis S. Yff, Hengelo, Netherlands

[73] Assignee: Hollandse Signaalapparaten B.V., Hengelo, Netherlands

[21] Appl. No.: 347,312

[22] Filed: May 3, 1989

[30] Foreign Application Priority Data

May 9, 1988 [NL] Netherlands ..... 8801203
Jan. 19, 1989 [NL] Netherlands ..... 8900117

[51] Int. Cl.[5] ..... F41G 7/30
[52] U.S. Cl. ..... 244/3.14; 244/3.21
[58] Field of Search ..... 244/3.11, 3.14, 3.21

[56] References Cited

U.S. PATENT DOCUMENTS 2,995,749 8/1961 Robinson, Jr. ..... 24/3.14
4,219,170 8/1980 Esker ..... 244/3.14
4,328,938 5/1982 Reisman et al. ..... 244/3.21
4,646,990 3/1987 Cleveland, Jr. ..... 244/3.21
4,750,689 6/1988 Yff ..... 244/3.14

*Primary Examiner*—David H. Brown
*Attorney, Agent, or Firm*—Robert J. Kraus

[57] ABSTRACT

A system for determining the angular spin position of a second object (1) spinning about an axis. A first object (7) emits electromagnetic waves. The second object (1) is provided with directional receiving antenna means (10) and with a receiving system (13) which, using the receiving antenna means (10), process in combination the carrier waves received to obtain said angular spin position. The received signals comprise at least one polarized first carrier wave and a second carrier wave which comprises phase information of the first carrier wave.

39 Claims, 9 Drawing Sheets

SYSTEM FOR DETERMINING THE ANGULAR SPIN POSITION OF AN OBJECT SPINNING ABOUT AN AXIS

BACKGROUND OF THE INVENTION

The invention relates to a system for determining the angular spin position of a second object spinning about an axis, where a first object emits electromagnetic waves and where the system is provided with directional receiving antenna means fitted to the second object, and with a receiving system which, using the receiving antenna means, process in combination the carrier waves received to obtain said angular spin position.

Such an arrangement is known from EP-A No. 0,239,156, corresponding to U.S. Pat. No. 4,750,689. This patent particularly applies to a second object in the shape of a projectile. In case of fired projectiles, such as shells, it is often desirable to change the course during the flight. However, since a shell spins about its axis along the trajectory, correction of its course is effective only if at any random instant the associated spin or roll position $\phi_m(t)$ is well-known. Suitable course correction means for this purpose are preferably based on the principles of aerodynamics, chemistry, gas theory and dynamics. In this respect, considered are the deployment of damping fins or surfaces on the projectile's circumferential surface, the detonation of small charges on the projectile, and the ejection of a small mass of gas from the projectile.

According to the EP patent specification this problem is solved by transmitting signals consisting of at least two superimposed phase-locked and polarised carrier waves having different frequencies. These signals are transmitted by the first object.

Thus it is possible to obtain a reference signal by processing both carrier waves in combination. This reference signal comprises phase information of both carrier waves. By means of this reference signal, the 180° uncertainty can be eliminated. It is clear from FIG. 1 of the EP patent that also a third carrier wave is present for transmitting data to the projectile by means of the transmitter. After this, for instance, the information on angle $\phi_g$ is transmitted upon which a correction is to be carried out by the projectile. For this purpose, the projectile itself determines the instantaneous angular spin position $\phi_m(t)$ and carries out a correction as soon as $\phi_g=\phi_m(t)$.

SUMMARY OF THE INVENTION

The present invention has for its object to simplify and improve the above system and is characterised in that the received signals comprise at least one first polarised carrier wave and a second carrier wave, which comprises phase information of the first carrier wave.

Contrary to the EP patent, according to the present invention, the information for obtaining the reference signal is carried fully by the second carrier wave. As a result, the receiving system of the second object (the projectile) may be of a much simpler and thus more cost-effective construction. Another advantage is that the reference signal may be determined more accurately. Moreover, the second carrier wave can be used to transmit other information (such as $\phi_g$), resulting in a further cost reduction because there will be no need for a third carrier wave.

According to a special embodiment of the invention, it is even feasible to use the fins of a projectile as an antenna system. By means of these fins, the first as well as the second carrier wave can be received. This results in a further cost reduction, while improving the robustness of the system.

According to another advantageous embodiment of the invention, the orientation of the first object is unimportant in the determination of the angular spin position of the second object with respect to, for instance, the earth surface. This is not possible in conventional systems as the angular spin position of the second object is determined with the first object as reference. In conventional systems this implies that the orientation of the second object with respect to the earth surface must be known and be kept constant. If the first object is, for instance, a ship, a transmitter and antenna unit of the first object, transmitting the at least one polarised carrier wave, will have to be fitted on a stabilised platform. Only then it is possible in conventional systems to keep the polarisation direction of the transmitted carrier waves with respect to space (the earth surface) constant.

The use of a stabilised platform however is rather expensive. Moreover, the means must be available to measure and process the position and orientation of the platform in order to obtain an angular spin position of the second object with respect to space. This renders the system inaccurate as well as more expensive.

In conventional systems, a polarised carrier wave around the second object is obtained by transmitting a polarised carrier wave. This has the disadvantage that a polarising transmitter and antenna unit needs to be used. Such transmitter and antenna units have the disadvantage that they are rather bulky and thus quite expensive.

According to an especially cost-effective embodiment of the invention, however, a transmitter and antenna unit is used which transmits carrier waves reaching up to and around the second object but also up to and interfering with the earth surface. Moreover, the transmitter and antenna unit of the first object is thus arranged that the frequency of the first carrier wave to be transmitted is relatively low, i.e. around 50 kHz. These technical measures result in a carrier wave of which the electric field component is vertically disposed with respect to the earth surface. The latter is entirely independent of the orientation of the transmitter and antenna unit. Similarly, the magnetic field component of the first carrier wave is horizontally disposed with respect to the earth surface. This results in the enormous advantage of being able to measure the rotation of the angular spin position of the second object with respect to the earth surface. Moreover, there is no need to fit the transmitter and antenna unit, when used on a ship, on to a stabilised platform.

The above also results in a much simpler and cheaper embodiment of the transmitter and antenna unit, because said system needs not be suitable for the generation of polarised carrier waves with an accurately defined polarisation direction. Moreover, determination and calculation of the angular spin position are also simpler and cheaper as the orientation of the first object is of no importance.

BRIEF DESCRIPTION OF THE DRAWING

The invention will now be described in more detail with reference to the accompanying drawing of which.

DESCRIPTION OF THE PREFERRED EMBODIMENTS

Figure 1B:
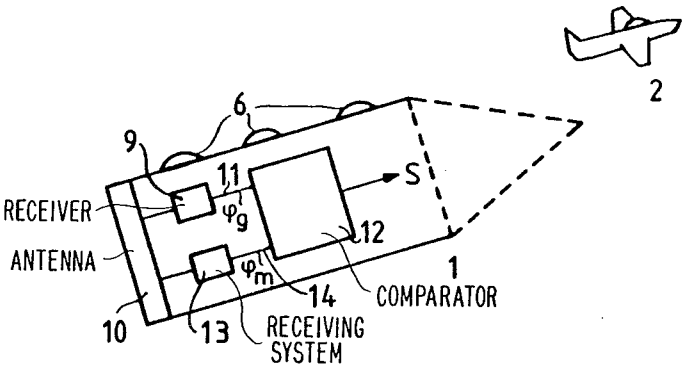
FIG. 1*b* is a schematic representation of a projectile controlled by the system of FIG. 1*a;*
Figure 1A:
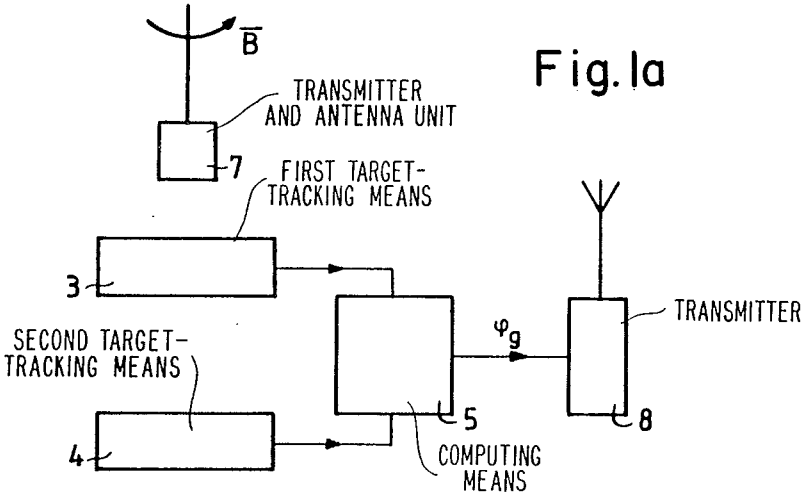
FIG. 1*a* is a schematic representation of a first embodiment of a complete system for the control of a projectile functioning as the second object, taking into account an apparatus according to the invention.

In FIG. 1 it is assumed that a projectile 1 functioning as the second object has been fired to hit a target 2. The target trajectory is tracked from the ground with the aid of target tracking means 3. For this purpose, use may be made of a monopulse radar tracking unit operable in the K-band or of pulsed laser tracking means operable in the far infrared region. The trajectory of projectile 1 is tracked with comparable target tracking means 4. From the information of supplied target positions determined by target tracking means 3 and from supplied projectile positions determined by target tracking means 4, computing means 5 determines whether any course corrections of the projectile are necessary. To make a course correction, the projectile is provided with gas discharge units 6. Since the projectile rotates about its axis, a course correction requires the activation of a gas discharge unit at the instant the projectile assumes the correct position. To determine the correct position, carrier waves sent out by a transmitter and antenna unit 7 functioning as the first object are utilised. Computing means 5 determines the desired projectile angular spin position $\phi_g$ at which a gas discharge should occur with respect to the elecromagnetic field pattern of the carrier waves at the projectile position.

The position and attitude of the transmitter and antenna unit 7 serve as reference for this purpose. This is possible, because the field pattern and the projectile position in this field are known.

Figure 2:
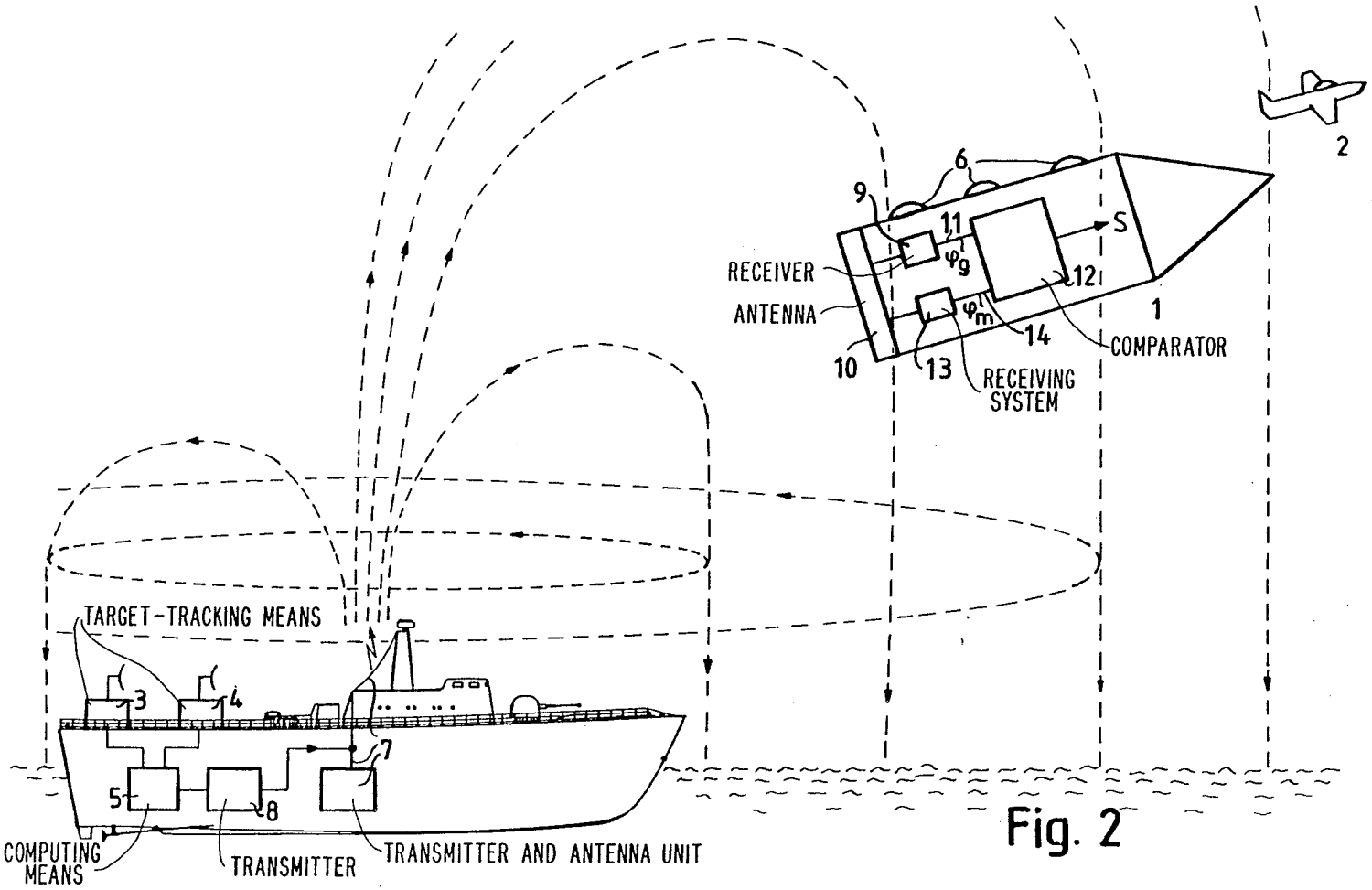
FIG. 2 represents a special embodiment of the system and the projectile in operation where the system is arranged in such a way that the orientation and position of the antenna unit of the system may remain undetermined.

According to a special embodiment of the invention, use of the position and orientation of the transmitter and antenna unit 7 as a reference is obviated. This is especially advantageous when the orientation of transmitter and antenna unit 7 is subject to movement, for instance, when it is placed on a ship (see FIG. 2). Antenna unit 7 of FIG. 2 is arranged in such a way that the transmitted carrier wave reaches up to and around the projectile and that the carrier wave reaches down to the earth surface. Moreover, the frequency of the transmitted carrier wave is relatively low with respect to conventional systems. The result of the above is that the electric field component $\bar{E}$ of the carrier wave is vertically polarised and that the magnetic field component is horizontally polarised with respect to the earth surface. The polarisation reaches greater heights as the frequency $\omega_o$ becomes lower and as the antenna unit is placed closer to the earth surface. As a result of these technical measures, the earth surface behaves as a flat conducting metal plate. The advantage is that the polarisation is independent of the orientation of antenna unit 7. Angles $\phi_m(t)$ and $\phi_g(t)$ can then be determined with the earth surface as a reference.

Antenna unit 7 is of an especially simple and cost-effective type, viz. a single wire. No use is made, as for conventional systems, of a stabilished platform onto which the antenna unit is fitted. Antenna unit 7 will therefore continuously change orientation as a result of the roll of the ship. Antenna unit 7 is also not suitable for transmitting polarised carrier waves, having as an advantage that the length of the antenna unit 7 can be limited. In this case, antenna unit 7 concerns a communication antenna already present on the ship.

The calculated value $\phi_g$ is transmitted by means of transmitter 8. For this purpose, transmitter 8 may be provided with its own antenna, as shown in FIG. 1, but may also use the communication antenna of the transmitter and antenna unit as shown in FIG. 2.

A receiver 9, accommodated in the projectile, receives from receiving antenna means 10 the value of $\phi_g$ transmitted by transmitter 8. The received value $\phi_g$ is supplied to a comparator 12 via line 11. A receiving system 13, fed with the antenna signals of two perpendicularly disposed directional antennas contained in receiving antenna means 10, determines the instantaneous projectile position $\phi_m(t)$ with respect to the electromagnetic field at the location of the directional loop antennas. The instantaneous value $\phi_m(t)$ is supplied to comparator 12 via line 14. When the condition $\phi_m(t)=\phi_g$ has been fulfilled, comparator 12 delivers a signal S to activate the gas discharge unit 6. At this moment a course correction is made. Thereafter this entire process can be repeated if a second course correction is required.

It should be noted that it is also possible to make the desired course corrections without the use of second target tracking means 4. The target tracking means 3 thereto measures the target trajectory. From the measuring data of the target trajectory the computing means 5 makes a prediction of the rest of the target trajectory. Computing means 5 uses this predicted data to calculate the direction in which the projectile must be fired. The projectile trajectory is calculated by computing means 5 from the projectile ballistic data. The target tracking means 3 keeps tracking the target 2. If it is found that target 2 suddenly deviates from its predicted trajectory, computing means 5 calculates the projectile course correction to be made. It is thereby assumed that the projectile follows its calculated trajectory. If the projectile in flight nears the target, this target will also get in the beam of the target tracking means 3.

From this moment onward it is possible to track both the target and the projectile trajectories, permitting computing means 5 to make some projectile course corrections, if necessary. As a result, any deviations from the calculated projectile trajectory, for example due to wind, are corrected at the same time.

It is also possible to eliminate the second tracking means 4 with the application of a time-sharing system. In such a case, the target and the projectile trajectories are tracked alternately by means of target tracking means 3. Any course corrections of the projectile are made analogously, as described hereinbefore.

Figure 3:
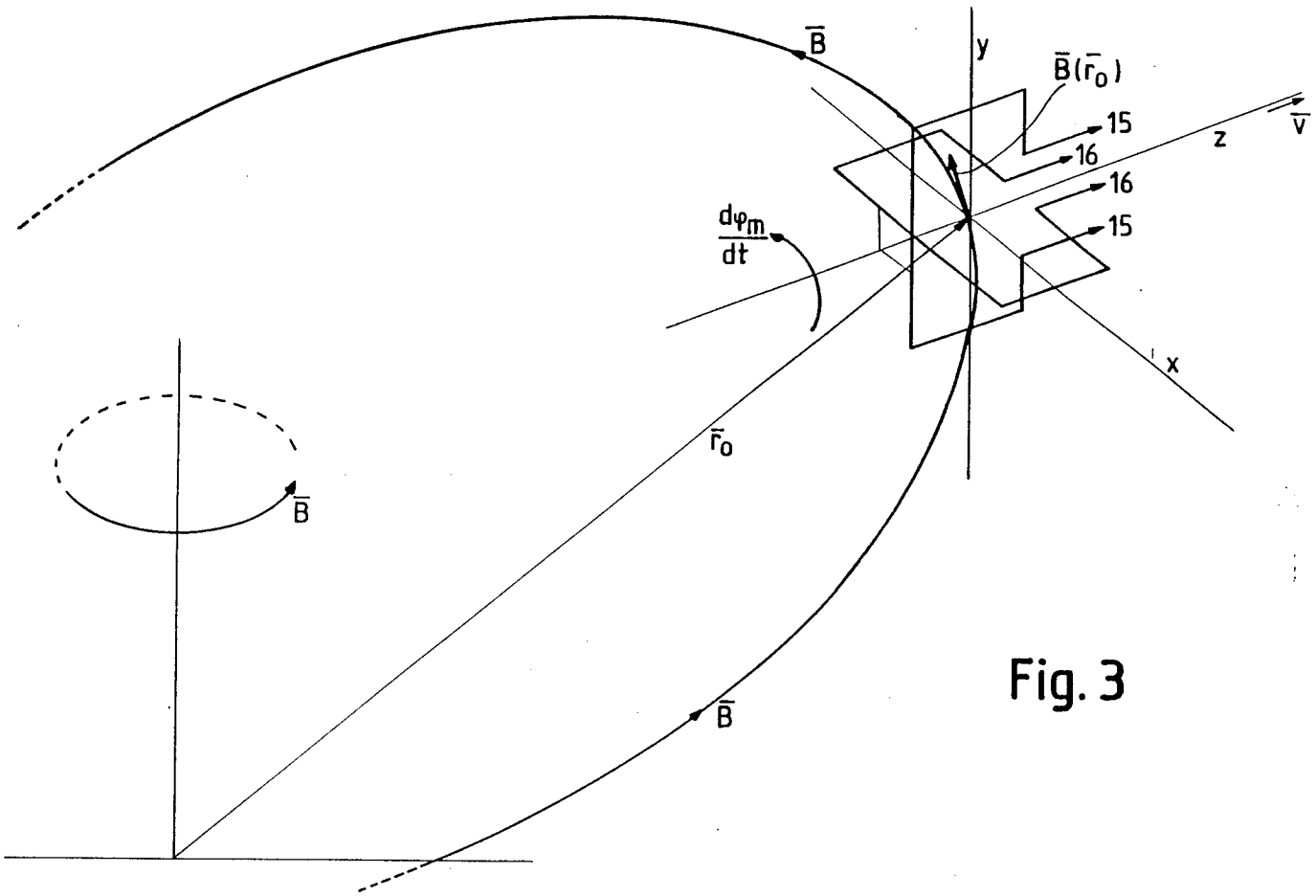
FIG. 3 is a schematic representation of two perpendicularly disposed loop antennas placed in an electromagnetic field.
Figure 4:
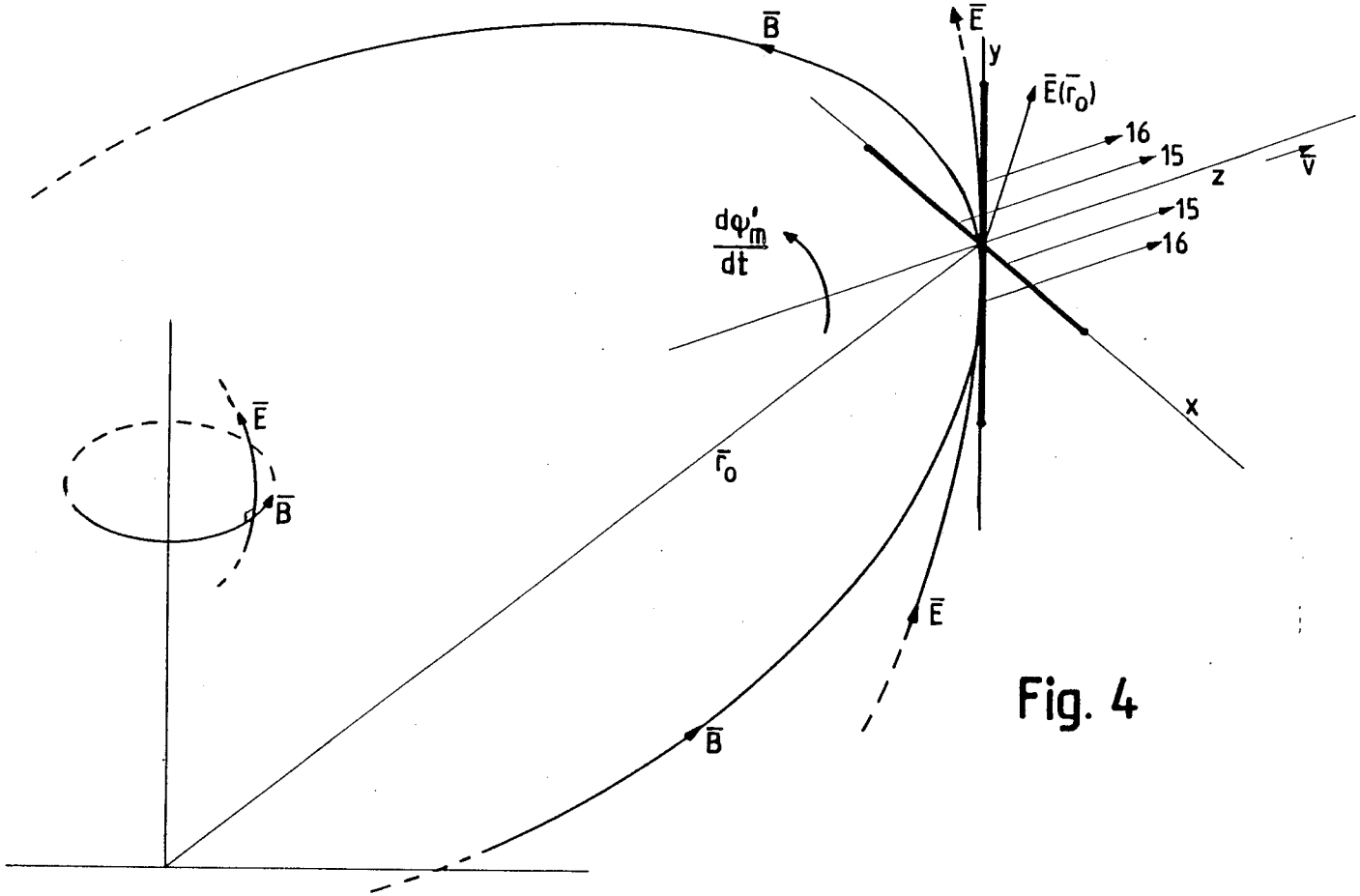
FIG. 4 is a schematic representation of two perpendicularly disposed dipole antennas placed in an electromagnetic field.

FIG. 3 and FIG. 4 show the two perpendicularly disposed directional antennas 15 and 16, forming part of the receiving antenna means 10. The antennas may comprise a B field or an E field. If two B field antennas are applied (such as represented in FIG. 3), the magnetic field components $\overline{B}$ of an electromagnetic field are detected. If two E field antennas are applied (such as represented in FIG. 4), the electric field components $\overline{E}$ of an electromagnetic field are detected. If one B field and one E field antenna are used, one subcomponent of field component $\overline{E}$ and one subcomponent of field component $\overline{B}$ are detected. Because field components $\overline{E}$ and $\overline{B}$ are connected to each other via the so-called relation of Maxwell, measurement of at least one of the components $\overline{E}$ or $\overline{B}$, or of one subcomponent of the $\overline{E}$ component and one subcomponent of the $\overline{B}$ will suffice.

Figure 5:
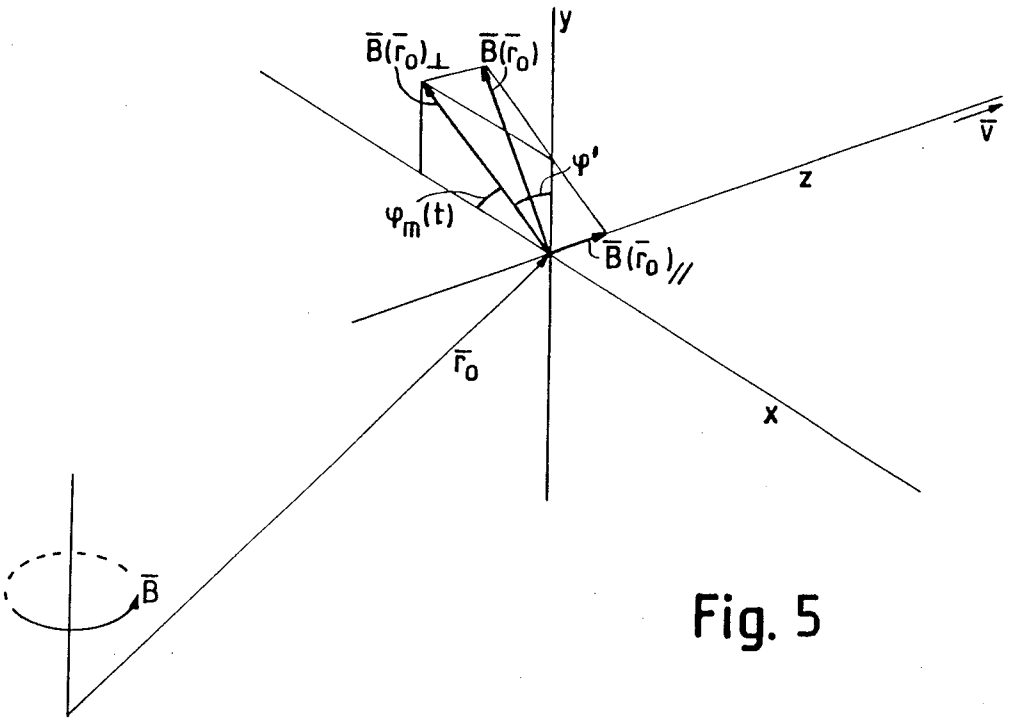
FIG. 5 is a diagram of a magnetic field at the location of the loop antennas.

For measuring the $\overline{B}$ component, a loop antenna can be used, while a dipole antenna may be used for measuring the $\overline{E}$ componet. An x,y,z coordinate system is coupled to one of the loop antennas. The propagation direction $\overline{v}$ of the projectile is parallel to the z-axis. The magnetic field component $\overline{B}$, transmitted by transmitter 8 has the magnitude and direction $\overline{B}(\overline{r}_o)$ at the location of the loop antennas. Here $\overline{r}_o$ is the vector with the transmitter and the antenna unit 7 as origin and the origin of the x,y,z coordinate system as end point. The magnetic field component $\overline{B}(\overline{r}_o)$ can be resolved into a component $\overline{B}(\overline{r}_o)_{//}$ (parallel to the z-axis) and the component $\overline{B}(\overline{r}_o)_{\perp}$ (perpendicular to the z-axis). Only the components $\overline{B}(\overline{r}_o)_{\perp}$ can generate an induction voltage in the two loop antennas. Therefore, as reference for the determination of $\phi_m(t)$ use is made of $\overline{B}(\overline{r}_o)_{\perp}$. In this case, $\phi_m(t)$ is the angle between the x-axis and $\overline{B}(\overline{r}_o)_{\perp}$, see FIG. 5. Since the computing means is capable of calculating $\overline{v}$ from the supplied projectile positions $\overline{r}$, computing means 5 can also calculate $\overline{B}(\overline{r}_o)_{\perp}$ from $\overline{B}(\overline{r}_o)$ and define $\phi_g$ with respect to this component.

Figure 6:
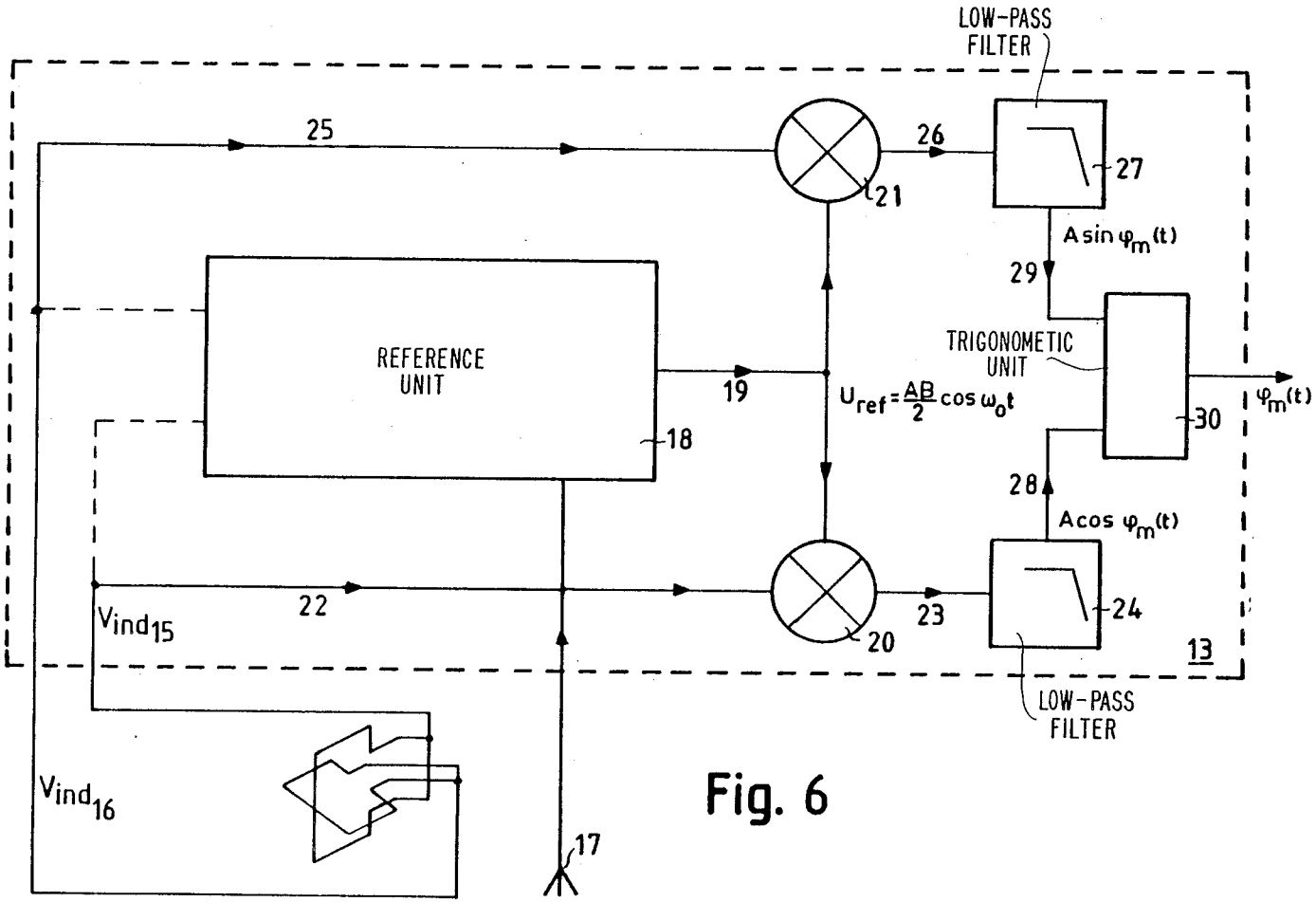
FIG. 6 shows a schematic representation of the receiving system included in a projectile to determine the angular spin position of the projectile.

FIG. 6 is a schematic representation of the receiving system 13. In the embodiment of system 13 in FIG. 6 it is assumed that the transmitter sends out an electromagnetic field consisting of a polarised carrier wave with frequency $\omega_o$. The magnetic field component $\overline{B}_{\perp}(\overline{r}_o)$ can be defined as $$B_{\perp}(r_o) = (a \sin \omega_o t)e, \text{ where } \frac{B_{\perp}(r_o)}{|B_{\perp}(r_o)|} = e \tag{1}$$

The magnetic flux $\Phi_{15}$ through the loop antenna 15 can be defined as:

$$\Phi_{15}=(a \sin \omega_o t).S.\cos \phi_m(t) \tag{2}$$

In this formula, S is equal to the area of the loop antenna 15. The magnetic flux $\Phi_{16}$ through loop antenna 16 can be defined as:

$$\Phi_{16}=(a \sin \omega_o t).S.\sin \phi_m(t) \tag{3}$$

The induction voltage in loop antenna 15 is now equal to:

$$V_{ind15} = -\epsilon \frac{d\phi}{dt} \equiv -\epsilon(a\ \omega_o \cos \omega_o t) \cdot S \cdot \cos \phi_m(t) + -\epsilon(a \sin \omega_o t) \cdot S \cdot \sin \phi_m(t) \cdot \frac{d\phi_m}{dt} \tag{4}$$

Here $\epsilon$ is a constant which is dependent upon the used loop antennas 15, 16. Since the projectile speed of rotation $d\phi m/dt$ is much smaller than the angular frequency $\omega_o$, it can be approximated that:

$$V_{ind15}=-\epsilon(a\omega_o\cos \omega_o t)\omega_o(t).S.\cos \phi_m(t)=(A\cos \omega_o t).\cos \phi_m(t) \tag{5}$$

Similarly, for loop antenna 16:

$$V_{ind16}=(A\cos \omega_o t).\ \sin \phi_m(t) \tag{6}$$

Transmitter 8 also transmits an electromagnetic wave E where:

$$E(t)=G(t) \cos \omega_1 t \text{ with } G(t)=D.(1-\beta\omega_o t).$$

In this formula, D is a constant and $\beta$ the modulation depth, so $0<\beta<1$. Also, $\omega_1>>\omega_0$. According to this embodiment, frequency $\omega_1$ is FM-modulated to comprise the information concerning $\phi_g$. The electromagnetic wave is therefore modulated with $\cos \omega_o t$ and thus comprises phase information of the signal transmitted by antenna unit 7. Receiving antenna means 10 is provided with an antenna 17 for the reception of signal E(t). Antenna 17 is linked with a reference unit 18, which generates a reference signal $U_{ref}$ from the received signal E(t), with $$U_{ref}=C\cos \omega_o t. \tag{7}$$

Here C is a constant which is dependent upon the specific embodiment of reference unit 18. The $U_{ref}$ signal is supplied to mixers 20 and 21 via line 19.

Signal $V_{ind15}$ (t) is also applied to mixer 20 via line 22.

The output signal of mixer 20 is applied to low-pass filter 24 via line 23. The output signal $U_{24}(t)$ of the low-pass filter 24 (the component of frequency $d\phi m/dt$) is equal to:

$$U_{24}(t) = \frac{AC}{2} \cos \phi_m(t) \tag{8}$$

In a fully analogous way, signal $V_{ind16}(t)$ is fed to mixer 21 via line 25. The output signal of mixer 21 is fed to a low-pass filter 27 via line 26. Output signal $U_{27}(t)$ of the low-pass filter 27 is equal to:

$$U_{27}(t) = \frac{AC}{2} \sin \phi_m(t) \tag{9}$$

From formula (8) and (9) and for a given $U_{24}(t)$ and $U_{27}(t)$, it is simple to determine $\phi_m(t)$. To this effect, signals $U_{24}(t)$ and $U_{27}(t)$ are sent to a trigonometric unit 30 via lines 28 and 29. In response to these signals, trigonometric unit 30 generates $\phi_m(t)$. Trigonometric unit 30 may, for instance, function as a table look-up unit. It is also possible to have the trigonometric unit functioning as a computer to generate $\phi_m(t)$ via a certain algorithm.

Figure 7:
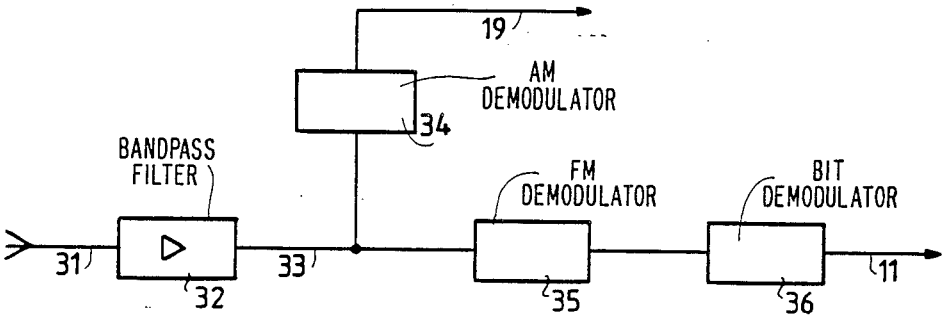
FIG. 7 is a first embodiment of a unit from FIG. 6.

FIG. 7 represents an embodiment of reference unit 18. Antenna signal E(t) is supplied to a bandpass filter 32 via line 31. Bandpass filter 32 only passes signals with a frequency of around $\omega_1$. Signal B(t) will therefore not be passed. Signal E(t) is subsequently supplied to an AM demodulator 34 via line 33 to obtain $U_{ref}$ on line 19. The reference unit may be additionally provided with an FM demodulator 35 and a bit demodulator 36. In that case, signal E(t) is also used as an information channel. The information is FM modulated and transmitted with signal E(t). This enables the required angle $\phi_g$ to which the correction of the projectile is to be carried out to be received, FM demodulated and bit demodulated from signal E(t). In this case, receiver 9 of FIG. 1 is not required because reference unit 18 determines $\phi_g$ by itself.

Figure 8:
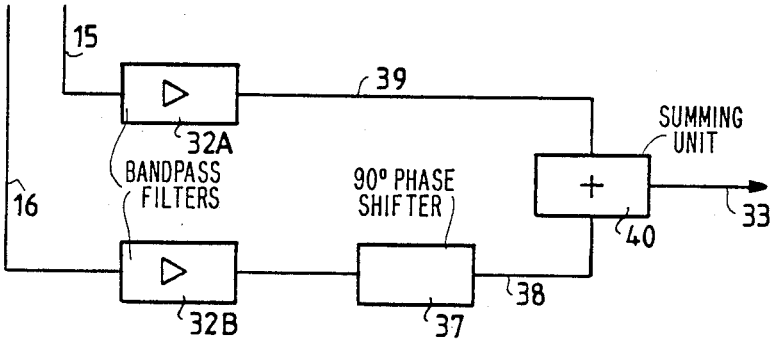
FIG. 8 is a second embodiment of a unit from FIG. 6.

FIG. 8 represents a special embodiment of reference unit 18. According to this embodiment, the task of antenna 17 is replaced by both antennas 15 and 16. For this purpose, reference unit 18 is provided with two bandpass filters 32A and 32B having the same function as the bandpass filter of FIG. 7. The output signal of bandpass filter 32B is supplied to a 90° phase shifter 37. The output signal of the phase shifter is supplied via line 38 to summing unit 40. Owing to the 90° phase shifter 37, the signals when summed will supplement each other and an output signal will be obtained having a constant amplitude. The output signal of summing unit 40 is equal to the signal on line 33 as described in FIG. 7. The output signal of summing unit 40 is processed by means of an AM demodulator 34, FM demodulator 35 and bit demodulator 36 in the same way as described for FIG. 7.

In FIG. 3 the directional antennas are represented as two loop antennas. However, it is also possible to use two perpendicularly disposed dipole antennes. In that case, the E field instead of the B field of the electromagnetic field is measured. Because the E field and the B field are connected via the well-known relation of Maxwell, the principle of the invention remains the same. The dipole antennas are preferably positioned perpendicularly to the surface of the former loop antennas (see FIG. 4).

Figure 9:
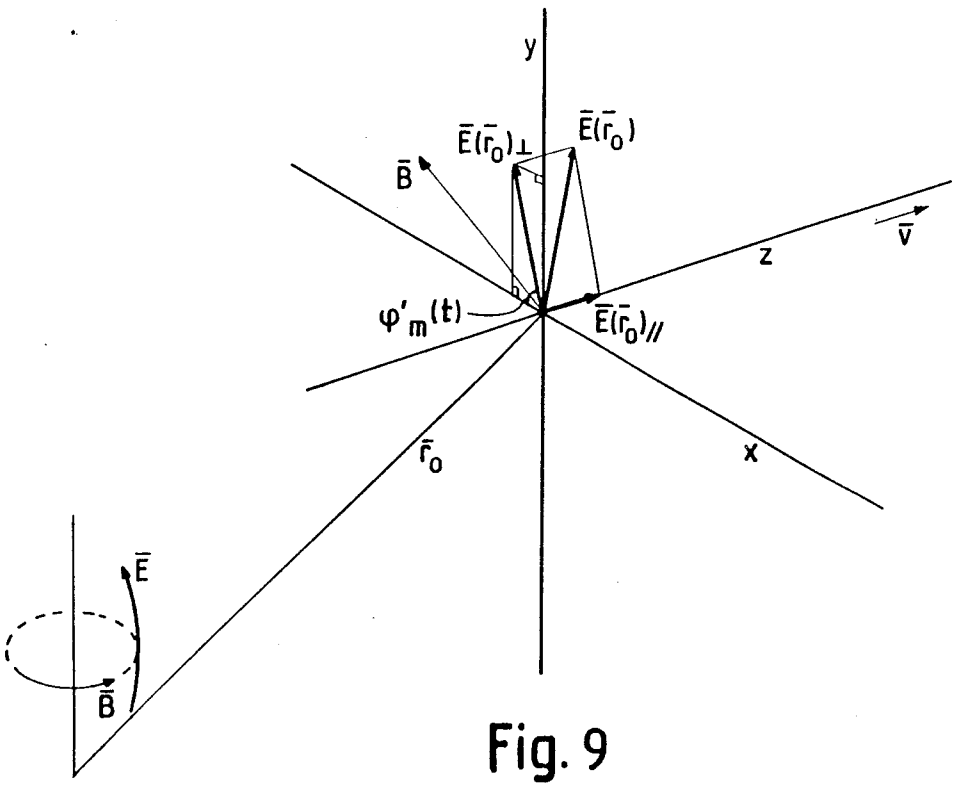
FIG. 9 is a diagram of an electric field at the location of the dipole antennas.

FIG. 4 represents, besides the B field, also the E field. In this case, the E field instead of the B field as represented in FIG. 3 now functions as reference for measurement of the instantaneous angular position $\phi'_m(t)$ of the projectile. A first dipole antenna is for this purpose positioned parallel with the x axis, while a second dipole antenna is positioned parallel with the y axis. The E field at the dipole antennas is described by $\bar{E}(\bar{r}_o)$. The E field can be disintegrated into two components $\bar{E}(\bar{r}_o)_{//}$ and $\bar{E}(\bar{r}_o)_\perp$ as represented in FIG. 9. Only the $\bar{E}(\bar{r}_o)_\perp$ component will generate a voltage in the dipole antennas.

The $\bar{E}(\bar{r}_o)_\perp$ field component can be expressed by:

$$\bar{E}(\bar{r}_o)_\perp = a' \cos \omega_o t\, \bar{e} \tag{10}$$

with $$\bar{e} = \frac{\bar{E}(\bar{r}_o)_\perp}{|\bar{E}(\bar{r}_o)_\perp|} \tag{11}$$

Voltage $V'_{15}$ in the dipole antenna parallel with the x axis is equal to:

$$V'_{15} = \bar{E}(\bar{r}_o)_\perp \cos \phi'_m(t).h_x \tag{12}$$

where $h_x$ is the length of the dipole antenna. In a fully analogous way, voltage $V'_{16}$ in the dipole antenna along the y axis is equal to $$V'_{16} = \bar{E}(\bar{r}_o)_\perp \sin \phi'_m(t).h_y \tag{13}$$

where $h_y$ is the length of the dipole antenna along the y axis. Combination for formulas (11), (12) and (13) results in:

$$V'_{15} = a' h_x \cos \omega_o t. \cos \phi'_m(t) \tag{14}$$

$$V'_{16} = b' h_y \cos \omega_o t. \sin \phi'_m(t) \tag{15}$$

Fully analogous to the description to formulas (5) and (6), angle $\phi'_m(t)$ can be determined from formulas (14) and (15) by means of the reference signal of formula (7). Thus the instantaneous position of the projectile is determined, as the E field is known.

Figure 10:
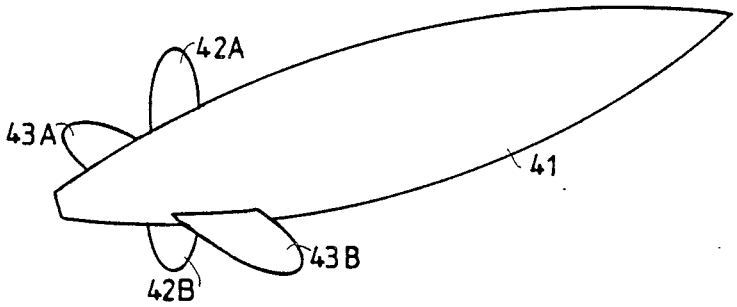
FIG. 10 is an embodiment of the projectile with dipole antennas.

A special embodiment of the dipole antennas is represented in FIG. 10. Projectile 41 in FIG. 10 is provided with two pairs of fins 42A, 42B, 43A and 43B. Fins 42A, 42B, like fins 43A, 43B, are positioned at opposite angles, while fins 42A and 43A on the one hand and 42B and 43B on the other hand are perpendicularly disposed.

Fins 42A and 42B together form a first dipole antenna 15 and fins 43A and 43B form a second dipole antenna 16 perpendicularly positioned to dipole antenna 15. In this case, the fins also function, like antenna 18, for reception of the data signal. Signals $V'_{15}$, $V'_{16}$, $\phi'_m(t)$, $U_{ref}$ and $\phi_g$ can be determined by means of the fins as described above for FIG. 8.

It will be clear that it is not necessary to perpendicularly dispose the dipole antennas, loop antennas and/or fins. Moreover, for the sake of redundancy more than two antennas may be used. Thus for instance six fins may be fitted at a 60° angle.

If one dipole antenna and one loop antenna are used which are not perpendicularly disposed, the instantaeous angular spin position of the object can also be determined. If one dipole antenna 15 is parallel with a loop antenna 16 (parallel with the x axis), in a fully analogous way as described above:

$$V'_{15} = a' h_x \cos \omega_o t. \cos \phi'_m(t) \tag{16}$$

$$V_{ind16} = A \cos \omega_o t. \cos \phi_m(t) \tag{17}$$

Because $\bar{E}$ and $\bar{B}$ are perpendicularly disposed:

$$\phi'_m(t) = 90° - \phi_m(t) \tag{18}$$

Substitution of (18) in (16) will result in:

$$V'_{15} = a' h_x \cos \omega_o(t) \sin \phi_m(t) \tag{19}$$

It will be clear that on the basis of formulas (19) and (17) the value of $\phi_m(t)$ can be determined as described above because a', $h_x$ and A are also known.

Figure 11B:
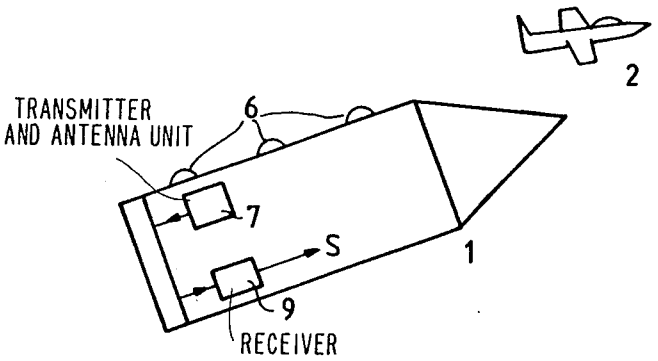
FIG. 11*b* is a schematic representation of a projectile controlled by the system of FIG. 11*a*.
Figure 11A:
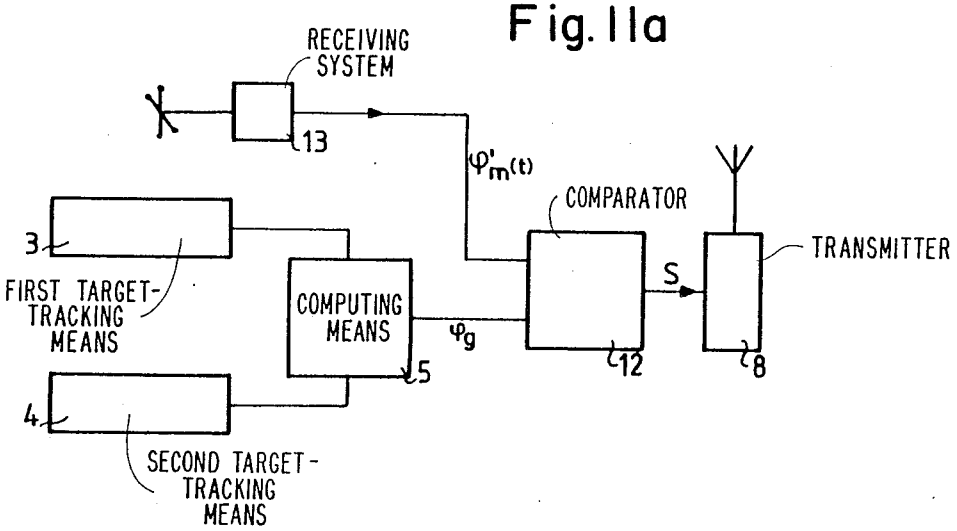
FIG. 11*a* is a schematic representation of a second embodiment of a complete system for the control of a projectile functioning as the first object, taking into account an apparatus according to the invention.

It will be clear that the method for determining the angular spin position of an object with the aid of a receiving system according to FIG. 6 can also be used if the projectile now functioning as the first object is equipped with the transmitter and antenna unit 7, while the receiving system 13 now functioning as the second object is installed, jointly with the loop or dipole antennas, on the ground (see FIG. 11).

Fully analogous to FIG. 1, the first target tracking means 3, the second target tracking means 4, and computing means 5 are used to determine the angular spin position $\phi_g$ of the projectile; this requires a course correction of the projectile 1 to hit the target 2. To determine the angular spin position of the projectile, the transmitter and antenna unit 7 is contained in the projectile 1. With the use of the loop or dipole antennas located on the ground and the receiving system 13, to which these antennas are mounted, it is possible to determine $\phi_m(t)$ in the same way as in FIG. 1, as here a relative angular spin position of the projectile with respect to the system 13 is concerned. The output signal $\phi_m(t)$ of the system 13 is applied to comparator 12. If the condition $\phi_m(t)=\phi_g$ is fulfilled, the comparator delivers a control signal to transmitter unit 8. This control signal is sent out for reception by the receiver 9 in the projectile. In response to this, receiver 9 activates the gas discharge units 6. If a second course correction is found to be necessary, this entire process can repeat itself.

I claim:

1. A system for determining the angular spin position of a second object spinning about an axis, where a first object emits electromagnetic carrier waves and where the system is provided with directional receiving antenna means fitted to the second object, and with receiving means which, using the receiving antenna means, process in combination the carrier waves received to obtain said angular spin position, characterised in that the carrier waves comprise at least one first polarised carrier wave and a second carrier wave which comprises phase information of the first carrier wave.

2. A system as claimed in claim 1, characterised in that the receiving antenna means is provided with a loop antenna and a dipole antenna which are not perpendicularly disposed.

3. A system as claimed in claim 1, in which the second object consists of a projectile, characterised in that first and second antennas are connected to the projectile on the side turned away from the direction of flight.

4. A system as claimed in claim 1, in which the second object is provided with a missile having fins, characterised in that the fins of the missile serve as first and second antenna means.

5. A system as claimed in claim 4, characterised in that the missile is provided with four fins where adjacent fins are positioned at 90° angles.

6. A system as claimed in claim 1, characterised in that the second carrier wave has a modulation comprising a predetermined phase relation with the phase of the frequency of the first carrier wave.

7. A system as claimed in claim 6, characterised in that the modulation concerns an amplitude modulation.

8. A system as claimed in claim 7, characterised in that the phase of the amplitude modulation equals the phase of the frequency of the first carrier wave.

9. A system as claimed in one of the claims 1–7, characterised in that the second carrier wave has a frequency which is not the same as the frequency of the first carrier wave.

10. A system as claimed in claim 9, characterised in that the frequency of the first carrier wave is lower than the frequency of the second carrier wave.

11. A system as claimed in claim 1, characterised in that the second carrier wave is also suitable for sending information.

12. A system as claimed in claim 1, characterised in that the receiving antenna means is at least provided with a first and a second directional antenna having a different orientation with respect to each other.

13. A system as claimed in claim 12, characterised in that both antennas are perpendicularly disposed.

14. A system as claimed in one of the claims 12 or 13, characterised in that the first and the second antenna are both provided with a loop antenna.

15. A system as claimed in one of the above claims 12 or 13, characterised in that the first and the second antenna are both provided with a dipole antenna.

16. A system as claimed in one of the claims 11–13, characterised in that the first and the second antenna are suitable for the reception of said carrier waves.

17. A system as claimed in one of the claims 11–13, characterised in that the receiving antenna means is provided with a third antenna for the reception of the second carrier wave while the first and the second antenna are suitable for the reception of the first carrier wave.

18. A system as claimed in claim 12, characterised in that the receiving means comprises:

a. a reference unit for obtaining a reference signal from the second carrier wave received by the receiving antenna means, the phase of said reference signal having a predetermined relation with the phase of the carrier wave frequency of said first carrier wave;

b. a first and a second mixer for mixing with said reference signal the first carrier wave received by means of the first or the second directional antenna;

c. a first and a second filter unit for filtering the output signals of said first and second mixers, said filters passing only frequency components equal or substantially equal to zero; and d. a trigonometric unit controlled by the output signals of the first and second filters, which trigonometric unit generates a signal representing the instantaneous angle between one of the antennas and the polarisation direction of the carrier wave.

19. A system as claimed in claims 18, characterised in that the reference unit comprises a phase-shifter for shifting the components of the first and second carrier wave, received by the receiving antenna means, 90° with respect to each other, a summing unit for summing the components shifted in phase with respect to each other, and a demodulator for demodulating the summing signal of the summing unit where the demodulated signal is suitable to serve as reference signal.

20. A system as claimed in claim 18, characterised in that the reference unit is provided with a demodulator for obtaining a reference signal from the second carrier wave received by means of a third antenna.

21. A system as claimed in claim 18, characterised in that the second carrier wave includes data information and the reference unit is provided with a filter for filtering out the data information.

22. A system as claimed in claim 18, characterised in that the trigonometric unit consists of a table-look-up generator generating $\phi$ from two input signals A cos $\phi$ and A sin $\phi$.

23. A system as claimed in claim 18, characterised in that the trigonometric unit consists of a computer calculating $\phi$ from two input signals A cos $\phi$ and A sin $\phi$.

24. A system as claimed in claim 1, where the first object is provided with a transmitter and antenna unit having such a range that the at least one carrier wave reaches up to and around the second object as well as down to the earth surface.

25. A system as claimed in claim 24, where the at least one carrier wave has an electric field component having an orientation which is independent of the orientation of the transmitter and antenna unit.

26. A system as claimed in one of the above claims 24 or 25, where the angular spin position is measured of the second object with respect to the earth surface.

27. A system as claimed in one of the above claims 24 or 25, where the frequency of the first carrier wave is around 50 kHz.

28. A system as claimed in one of the above claims 24 or 25, where the first object concerns a vehicle and where the transmitter and antenna unit is rigidly or almost rigidly connected to the vehicle.

29. A system as claimed in claim 28, where the vehicle is a ship.

30. A projectile including means for determining an angular spin position of the projectile relative to a first object from electromagnetic carrier waves received from the first object, said carrier waves comprising a first polarized carrier wave and a second carrier wave including phase information of the first carrier wave, said projectile including directional receiving antenna means for receiving the carrier waves and receiving means coupled to the antenna means for processing said carrier waves to obtain said angular spin position.

31. A projectile as in claim 30 where the antenna means comprises first and second antennas for receiving the first carrier wave and a third antenna for receiving the second carrier wave.

32. A projectile as in claim 36 where the receiving means comprises:

a. a reference unit for obtaining a reference signal from the second carrier wave received by the receiving antenna means, the phase of said reference signal having a predetermined relation with the phase of the carrier wave frequency of said first carrier wave;

b. a first and a second mixer for mixing with said reference signal the first carrier wave received by means of the first or the second directional antenna;

c. a first and a second filter unit for filtering the output signals of said first and second mixers, said filters passing only frequency components equal or substantially equal to zero; and d. a trigonometric unit controlled by the output signals of the first and second filters, which trigonometric unit generates a signal representing the instantaneous angle between one of the antennas and the polarisation direction of the carrier wave.

33. A projectile as in claim 32 where the reference unit comprises a phase-shifter for shifting the components of the first and second carrier wave, received by the receiving antennas means, 90° with respect to each other, a summing unit for summing the components shifted in phase with respect to each other, and a demodulator for demodulating the summing signal of the summing unit where the demodulated signal is suitable to serve as reference signal.

34. A projectile as in claim 32 where the reference unit includes a demodulator for obtaining a reference signal from the second carrier wave.

35. A projectile as in claim 32 where the second carrier wave includes data information and the reference unit includes a filter for filtering out said data information.

36. A projectile as in claim 30 where the antenna means comprises first and second directional antennas having different orientations with respect to each other.

37. A projectile as in claim 36 where the first and second directional antennas are perpendicularly disposed with respect to each other.

38. A projectile as in claim 36 or 38 where first and second directional antennas comprise loop antennas.

39. A projectile as in claim 36 or 38 where first and second directional antennas comprise dipole antennas.

* * * * *